US008376734B2

(12) United States Patent
Klein et al.

(10) Patent No.: US 8,376,734 B2
(45) Date of Patent: Feb. 19, 2013

(54) ROLLER HEARTH FURNACE FOR HEALING AND/OR TEMPERATURE EQUALISATION OF STEEL OR STEEL ALLOY CONTINUOUS CAST PRODUCTS AND ARRANGEMENT THEREOF BEFORE A HOT STRIP FINAL ROLLING MILL

(75) Inventors: Christoph Klein, Kreuztal (DE); Dieter Hofmann, Hilden (DE); Frank Benfer, Bad Laasphe (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 1019 days.

(21) Appl. No.: 12/223,740

(22) PCT Filed: Dec. 18, 2006

(86) PCT No.: PCT/EP2006/012164

§ 371 (c)(1),
(2), (4) Date: Jan. 12, 2009

(87) PCT Pub. No.: WO2007/090455

PCT Pub. Date: Aug. 16, 2007

(65) Prior Publication Data

US 2009/0298001 A1 Dec. 3, 2009

(30) Foreign Application Priority Data

Feb. 8, 2006 (DE) ..... 10 2006 005 635

(51) Int. Cl.
*F27B 9/28* (2006.01)

(52) U.S. Cl. ..... 432/8; 432/59; 432/121; 432/129; 266/277

(58) Field of Classification Search ..... 432/121, 432/122, 126, 127, 128, 129, 137, 143, 8, 432/59; 266/276, 274, 277; 148/566
See application file for complete search history.

(56) References Cited

U.S. PATENT DOCUMENTS

| | | | | |
|---|---|---|---|---|
| 4,212,635 | A * | 7/1980 | North | 432/239 |
| 4,217,095 | A * | 8/1980 | Tokitsu | 432/128 |
| 4,427,371 | A * | 1/1984 | Unks | 432/11 |
| 4,585,411 | A * | 4/1986 | Bocci et al. | 432/11 |
| 4,675,974 | A * | 6/1987 | Connolly | 29/527.7 |
| 5,115,547 | A | 5/1992 | Rohde | |
| 5,479,808 | A * | 1/1996 | Bricmont | 72/202 |
| 5,611,232 | A | 3/1997 | Rohde et al. | |
| 5,946,783 | A * | 9/1999 | Plociennik et al. | 29/33 C |
| 6,074,204 | A * | 6/2000 | Audebert et al. | 432/121 |
| 6,183,246 | B1 * | 2/2001 | Le Goueffec | 432/128 |
| 6,261,091 | B1 * | 7/2001 | Sakamoto et al. | 432/121 |

FOREIGN PATENT DOCUMENTS

| | | |
|---|---|---|
| EP | 0 361 057 | 4/1990 |
| JP | 57149008 | 9/1982 |
| JP | 7307194 | 12/1993 |
| JP | 9287018 | 11/1997 |

(Continued)

*Primary Examiner* — Gregory A Wilson
(74) *Attorney, Agent, or Firm* — Lucas & Mercanti, LLP; Klaus P. Stoffel

(57) ABSTRACT

The invention relates to a roller hearth furnace (1) for heating and/or temperature equilibration of continuous cast products (2), comprising a first series of rollers (13) running in the longitudinal direction (12) and a second parallel series of rollers (15) on the outlet side (14), wherein a buffer zone (16) with lifting elements (17) for the perpendicular transport of the continuous cast product (2) is arranged between the series of rollers (13, 15). Furthermore, alternative arrangements for a further process route (28) are provided.

9 Claims, 3 Drawing Sheets

FOREIGN PATENT DOCUMENTS

| | | |
|---|---|---|
| JP | 9296220 | 11/1997 |
| JP | 11043723 | 2/1999 |
| RU | 2108877 | 4/1998 |
| WO | 94/18514 | 8/1994 |

* cited by examiner

ROLLER HEARTH FURNACE FOR HEALING AND/OR TEMPERATURE EQUALISATION OF STEEL OR STEEL ALLOY CONTINUOUS CAST PRODUCTS AND ARRANGEMENT THEREOF BEFORE A HOT STRIP FINAL ROLLING MILL

BACKGROUND OF THE INVENTION

The invention concerns a roller hearth furnace for heating and/or temperature equalization of continuously cast products, especially those made of steel or steel materials, which are cut to lengths that fit the furnace and are then conveyed into and out of the furnace through the furnace chamber on rollers, and a method for using the roller hearth furnace upstream of a hot strip finishing train, in which the hot strip is subjected, among other operations, to rolling, cooling, and coiling into coils in a coiling station.

Roller hearth furnaces of this type are very long and are associated with thermal losses. In addition, due to the long time the continuously cast products lie on the rollers, these roller hearth furnaces cause impressions on the underside of the products as a result of scale caked on the product, and this later leads, during the rolling process, to reduced quality of the rolled product, especially rolled strip.

A roller hearth furnace of this type installed upstream of a hot strip finishing train is described, for example, in DE 44 11 216 A1. This furnace has stationary and traveling hearths, on whose refractory lining the pieces of material to be heated are laid. Sloping depressions are incorporated in the refractory lining to cause the pieces of material to be heated from below and to help remove scale. The scale is removed through travel grooves between the hearths and through scale drop shafts.

In the case of hearths formed by rollers, although the removal of scale is more favorable when the spaces between the rollers are short, residual pieces of scale are pressed into the strand material by the weight of heavy continuously cast products, such as cut lengths of slab, and cause the aforementioned surface defects, which, as described above, persist in the finished product. A traveling hearth equipped with rollers is disclosed, for example, by EP 0 361 057 B1. However, a design of this type results in an extremely complicated structure as a roller hearth and traveling hearth system comprising conveying rollers, which are supported outside the furnace chamber and can be moved into and out of spaces of the traveling hearth through openings in the side walls of the furnace. This results in large heat losses and low thermal efficiency.

Roller hearth furnaces for heating and/or temperature equalization of continuously cast products are known from the documents IT 1 236 130 B, EP 0 264 459 A1, EP 0 353 487 A1, WO 94/18 514 A and DE 35 25 457 A1. These roller hearth furnaces do not allow any change in the thermal efficiency.

SUMMARY OF THE INVENTION

The objective of the invention is to improve the conventional roller hearth furnace in such a way that it can be shortened, and the entire plant, consisting of a continuous casting installation and a hot strip finishing train (e.g., a CSP, i.e., a compact strip production, plant), can be shortened, and at the same time better thermal efficiency and thus energy savings can be realized. At the same time, it is desired that fewer damaging impressions be made on the underside of the continuously cast product.

In accordance with the invention, this objective is achieved with a roller hearth furnace which the first row of rollers and/or the second row of rollers each form a heating zone. This results in improved thermal efficiency and promotes energy savings. The slabs can be more strongly heated when necessary. This leads to an expansion of the product spectrum of the casting and rolling plant.

Another embodiment for improving the temperature level consists in providing the buffer zone with an additional heating zone that can be turned on and/or a holding zone.

In accordance with another feature of the invention, the lifting elements can consist of walking beams.

In accordance with another aspect of the invention, a method for using a roller hearth furnace of this type in the continuous casting of liquid metals, especially liquid steel materials, into slabs or flat, thin strands, so-called thin slabs, which after heating and/or temperature equalization in the roller hearth furnace, are descaled, cut to length, rolled into hot strip in a hot strip finishing train, cooled, and coiled into coils in a coiling station, is characterized by the fact that in a multiple-strand casting installation, a common roller hearth furnace or a separate roller hearth furnace for each strand, each having an entry side and a discharge side, which consist of parallel rows of rollers, and a buffer zone, which lies between them and consists of lifting elements, is provided for the common downstream process route. The advantages are shortening of the entire plant and energy savings and thus improved thermal efficiency and mechanical improvements.

In accordance with another embodiment (second alternative), it is proposed that the discharge side of a common roller hearth furnace for a twin-strand casting installation be placed in the line of the downstream process route in such a way that there is a mirror-image position of two entry sides with identical rows of rollers and a central discharge side with one row of rollers. The downstream hot strip finishing train can thus be supplied with cut lengths of the cast strand at shorter intervals.

A third alternative provides that a multiple-strand casting installation with a separate roller hearth furnace for each strand has a transverse conveyor that operationally connects both roller hearth furnaces after the discharge side and before the downstream process route. This makes it possible for a cut length to be delivered to the downstream process route from both casting installations of a twin-strand casting installation.

The invention also contemplates a conventional roller hearth furnace positioned upstream of a one-strand or multiple-strand continuous casting installation, which furnace can be further used in such a way that, in addition to a roller hearth furnace with an entry and discharge side and a buffer zone of lifting elements lying between them, a roller hearth furnace operating parallel in the longitudinal direction is provided, and that the roller hearth furnaces are connected to another roller hearth furnace, which is connected to the downstream process route and has an entry side, a parallel discharge side, and a buffer zone of lifting elements arranged between them (fourth alternative).

Finally, it is provided that the process route consists of a compact strip production (CSP) installation comprising a hot strip finishing train with seven rolling stands.

The drawings show specific embodiments of the invention, which are explained in greater detail below.

DETAILED DESCRIPTION OF THE INVENTION

Figure 1:
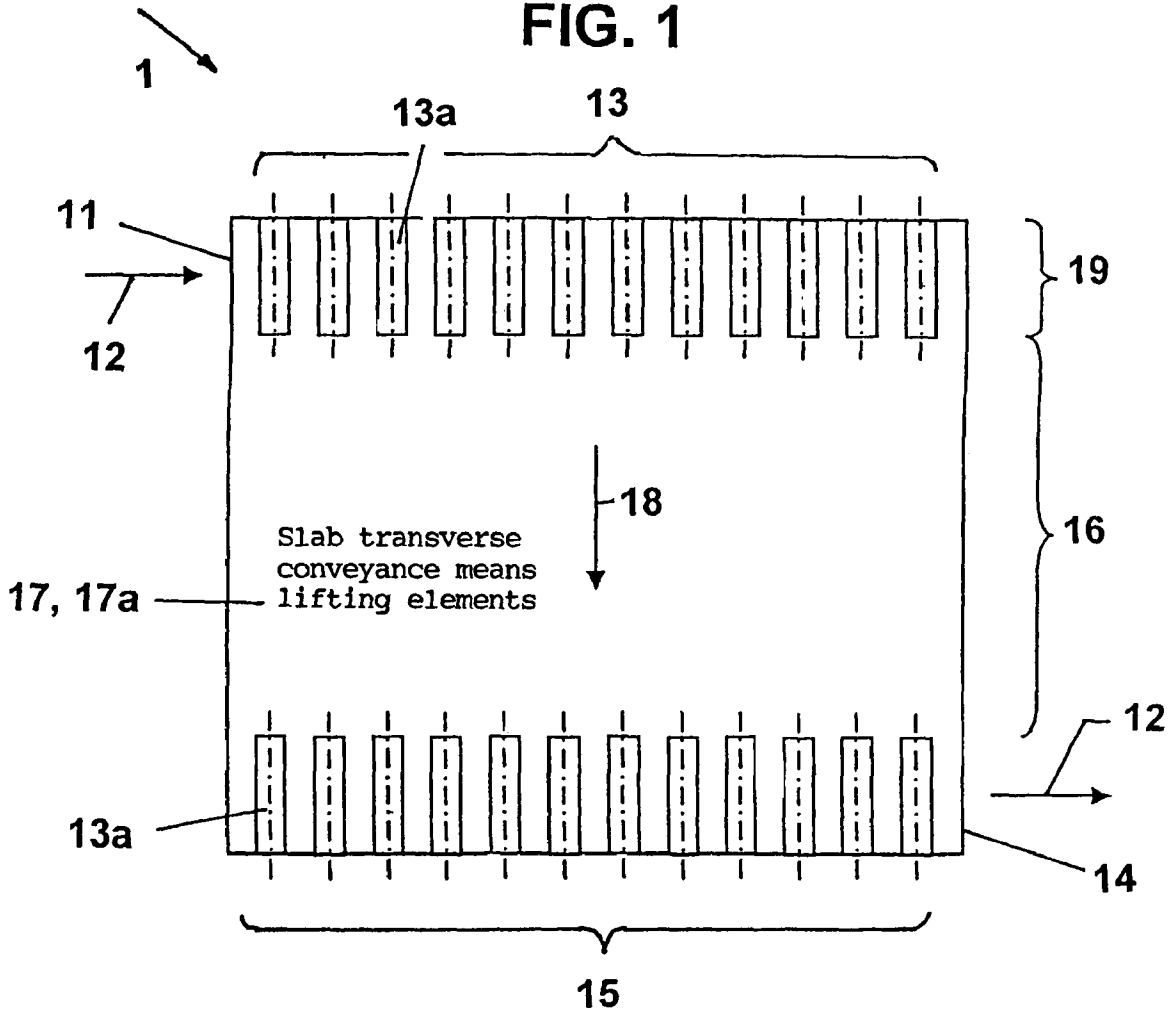
FIG. 1 is a plan view of the roller hearth furnace of the invention.

The roller hearth furnace 1 (FIG. 1) is used for heating and/or holding and/or temperature equalization of continuously cast products 2 (FIG. 2 to 5), which are cast from slab strands or flat, thin strands 3 (so-called thin slabs). To this end, molten metal flows from one of two casting ladles 4, which are located on opposite sides of a ladle turret 5 and can be swiveled into the tapping position, through a tundish with a continuous casting mold 6. The cast strand 6*a* formed in the continuous casting mold 6 is cooled and then further cooled and supported in a containment roll stand. The given continuously cast product 2 is freed of scale in a descaling unit 8 and cut into lengths 10 several meters long by shears 9. The cut lengths 10, which are cut to proper size for the furnace and rolling stands, are determined by the dimensions of the strand and by the downstream rolling process.

The cut lengths 10 are conveyed (FIG. 1) on an entry side 11 over a first row of rollers 13 that runs in the longitudinal direction 12 of the furnace 1. The length of the rollers 13*a* is slightly greater than the width of the continuously cast product 2.

Analogously to the entry side 11, a second row of rollers 15, which likewise consists of rollers 13*a* of this type, is arranged on the discharge side 14. The continuously cast products leave the row of rollers 15 on the discharge side 14 in the longitudinal direction 12. A buffer zone 16, which consists of lifting elements 17, which are not shown in detail, is formed between the first row of rollers 13 and the second row of rollers 15. The lifting elements 17 effect the transverse conveyance of the continuously cast product 2 in arrow direction 18. The first row of rollers 13, which runs in longitudinal direction 12, and/or the second row of rollers 15 forms a heating zone 19 that consists of standard heating devices, such as gas burners, induction heaters, and the like. An additional heating zone 19 that can be turned on and/or a holding zone can be provided in the buffer zone 16. The lifting elements 17 consist of standard walking beams 17*a*.

The shears 9 are followed by a roller hearth furnace 1 for each cast strand, and various alternative embodiments of the arrangement of said furnace are provided. In the example shown in FIG. 4, on the discharge side 14, there is a transverse conveyor 20 for connecting a twin-strand casting installation with a downstream multiple-stand rolling mill via emergency shears 21 and another descaling unit 22.

After the rolling stock has been rolled into thin hot strip 24, the metal strip is cooled in a cooling line 25 to steel strip with the appropriate microstructure and then coiled into coils 27 in a coiling station 26. The process route 28 of the rolling operation is the same in this respect in all of the specific embodiments of FIGS. 2 to 5.

Figure 2:
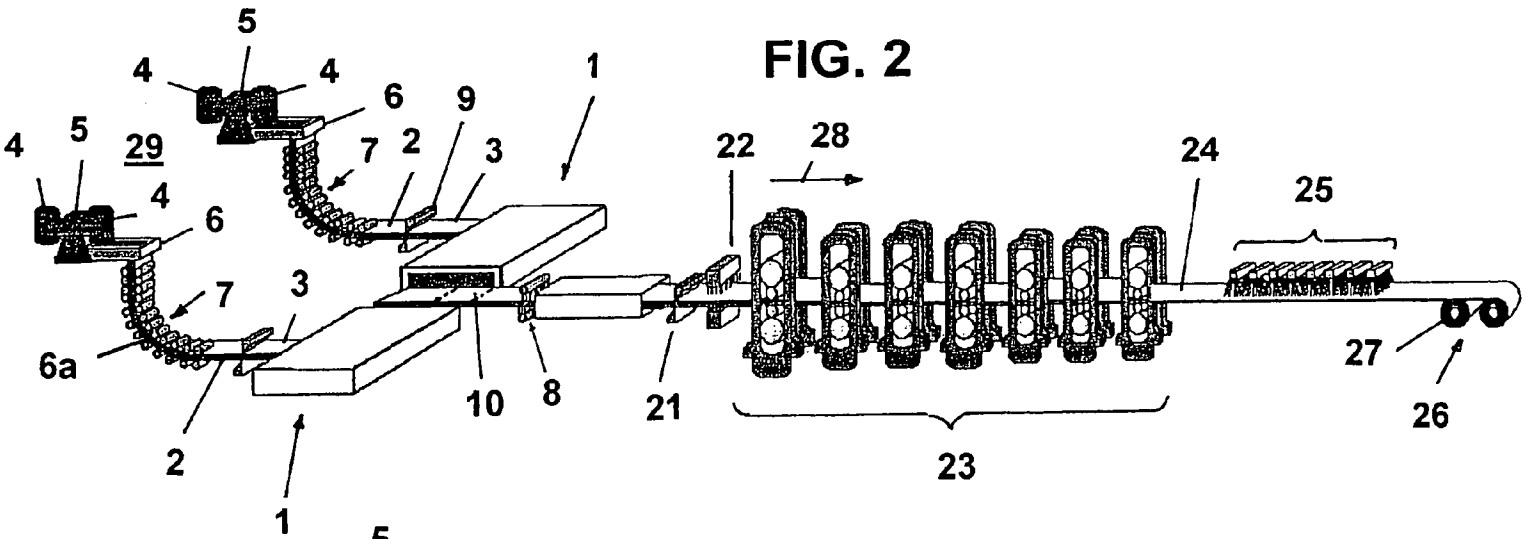
FIG. 2 is a perspective side view of the total plant with a first alternative arrangement of the roller hearth furnace.

According to FIG. 2, a separate roller hearth furnace 1 (in accordance with the invention, a so-called walking-beam roller hearth furnace), as described in connection with FIG. 1, is arranged in a multiple-strand casting installation 29 for each cast strand. Each roller hearth furnace 1 conveys the cut lengths 10 laterally into the line of the process route 28 (first alternative).

Figure 3:
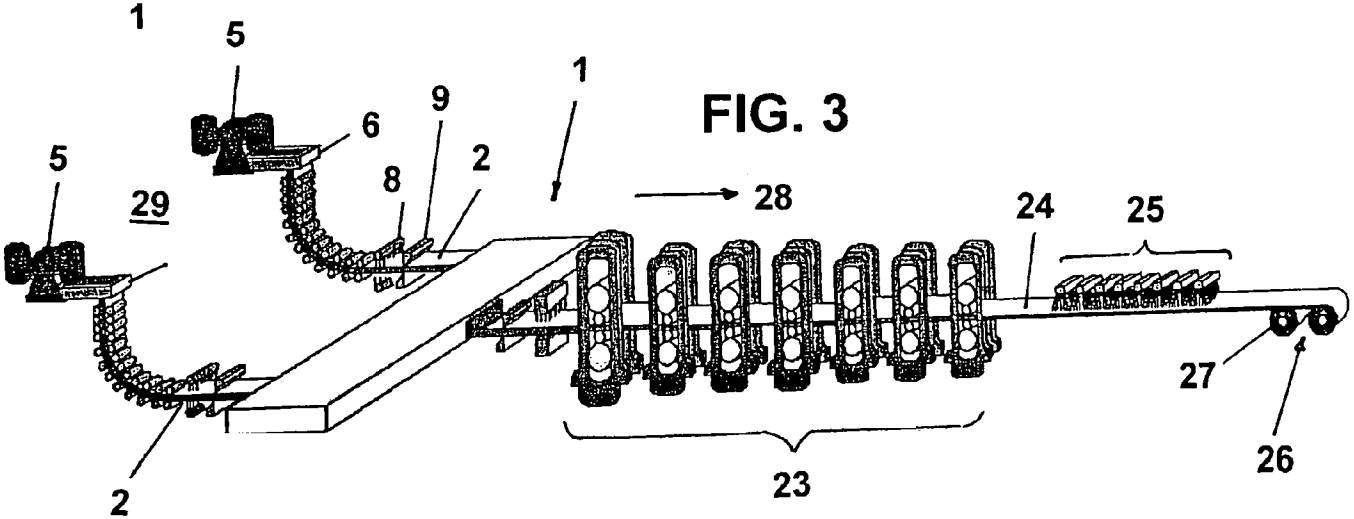
FIG. 3 is a perspective side view of the total plant with a second alternative arrangement of the roller hearth furnace.

FIG. 3 shows the transverse conveyance of both strands in opposite arrow directions 18 (second alternative).

Figure 4:
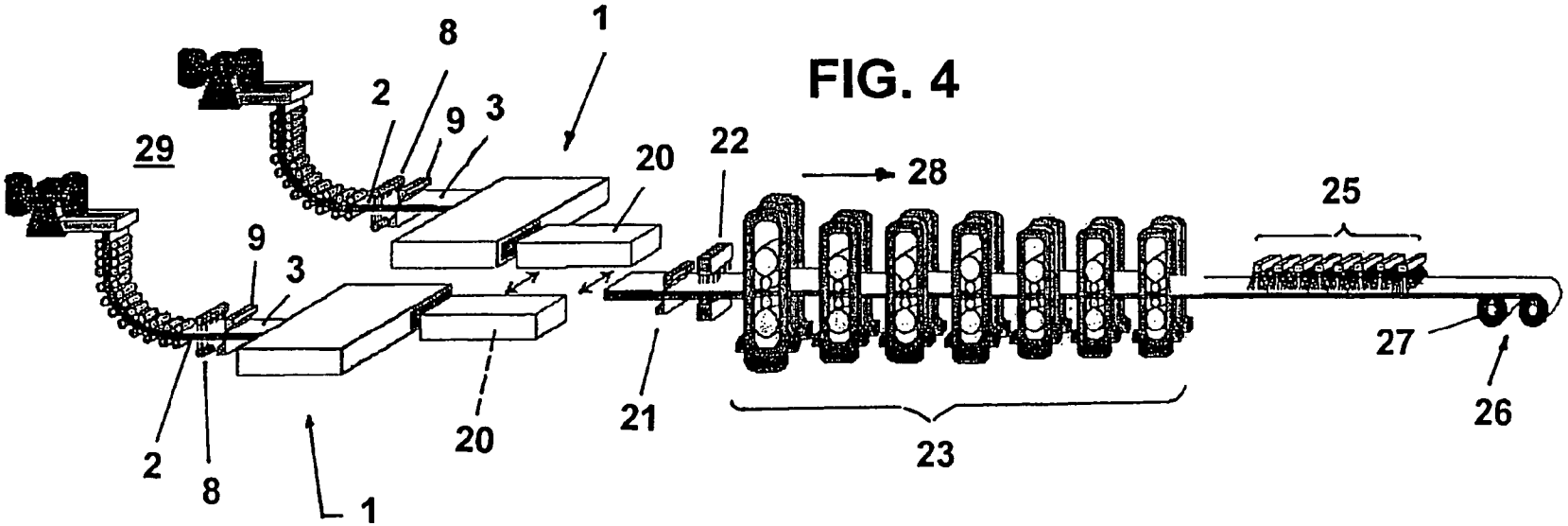
FIG. 4 is a perspective side view of the total plant with a third alternative arrangement of the roller hearth furnace of the invention.

According to FIG. 4, two separate roller hearth furnaces 1 are provided for the two strands, which are not positioned in the line of the downstream process route 28. Therefore, the cut lengths 10 are conveyed by the transverse conveyor 20 into the line of the common process route 28 (third alternative).

Figure 5:
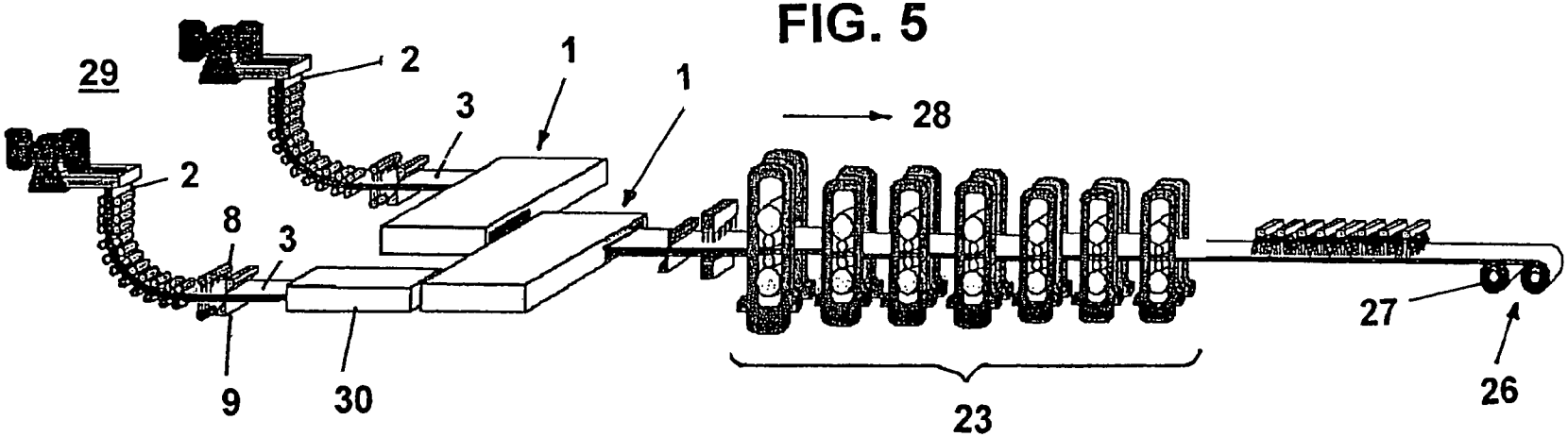
FIG. 5 is a perspective side view of the total plant with a fourth alternative arrangement of the roller hearth furnace.

FIG. 5 shows that a roller hearth furnace 30 that operates only in the longitudinal direction follows one of the strands (the one on the left in the drawing), and the roller hearth furnace 1 of the invention is used for the other strand (the one on the right). The cut lengths 10 can then again be conveyed via a common walking-beam roller hearth furnace 1 of the invention to the downstream process route 28 (fourth alternative).

LIST OF REFERENCE NUMBERS

1 roller hearth furnace
2 continuously cast product
3 slab strand; flat, thin strand (thin slab)
4 casting ladle
5 ladle turret
6 continuous casting mold
6*a* cast strand
7 containment roll stand
8 descaling unit
9 shears
10 cut length
11 entry side
12 longitudinal direction
13 first row of rollers
13*a* rollers
14 discharge side
15 second row of rollers
16 buffer zone
17 lifting elements
17*a* walking beams
18 arrow direction
19 heating zone
20 (transverse) conveyor
21 emergency shears
22 descaling unit
23 hot strip finishing train
24 hot strip
25 cooling line
26 coiling station
27 coil
28 process route
29 multiple-strand casting installation
39 roller hearth furnace operating in the longitudinal direction

The invention claimed is:

1. A roller hearth furnace (1) for heating and/or temperature equalization of continuously cast products (2), especially those made of steel or steel materials, which are cut to lengths (10) that fit the furnace and are then conveyed into and out of the furnace through the furnace chamber on rollers (13*a*), where a first row (13) of rollers, which extends in the longitudinal direction (12) of the furnace (1) and whose rollers (13*a*) have a length that corresponds to the width of the continuously cast product (2), is arranged on the entry side (11), where a second row (15) of rollers is arranged on the discharge side (14) parallel to the first row (13), and where between the first and the second rows (13, 15) of rollers there is a buffer zone (16) with lifting elements (17) for the transverse conveyance of the continuously cast product (2), wherein the first row (13) of rollers and/or the second row (15) of rollers extending in the longitudinal direction (12) of the furnace (1) each form a heating zone (19).

2. A roller hearth furnace in accordance with claim 1, wherein the buffer zone (16) is provided with an additional heating zone (19) that can be turned on.

3. A roller hearth furnace in accordance with claim 2, wherein the buffer zone is provided with a holding zone.

4. A roller hearth furnace in accordance with claim 1, wherein the lifting elements (17) consist of walking beams (17*a*).

5. A method for using a roller hearth furnace (1) in accordance with claim 1, in the continuous casting of liquid metals into slabs or flat, thin strands (3), so-called thin slabs, which after heating and/or temperature equalization in the roller hearth furnace (1), are subjected, among other operations, to rolling into hot strip (24) in a hot strip finishing train (23), cooling, and coiling into coils (27) in a coiling station (26), wherein in a multiple-strand casting installation (29), a common roller hearth furnace (1) or a separate roller hearth furnace (1) for each strand, each having an entry side (11) and a parallel discharge side (14), which consist of parallel rows (13, 15) of rollers, and a buffer zone (16), which lies between them and consists of lifting elements (17), is provided for the common downstream process route (28).

6. A method in accordance with claim 5, wherein the discharge side (14) of a common roller hearth furnace (1) for a twin-strand casting installation (29) is placed in the line of the downstream process route (28) in such a way that there is a mirror-image position of two entry sides (11) with identical rows (13, 13) of rollers and a central discharge side (14) with one row (15) of rollers.

7. A method in accordance with claim 5, wherein a multiple-strand casting installation (29) with a separate roller hearth furnace (1) for each strand has a transverse conveyor (20) that operationally connects both roller hearth furnaces (1, 1) after the discharge side (14) and before the downstream process route (28).

8. A method in accordance with claim 5, wherein in addition to a roller hearth furnace (1) with an entry side (11), a discharge side (14), and a buffer zone (16) of lifting elements (17) lying between them, a roller hearth furnace (30) operating parallel in the longitudinal direction (12) is used, where the roller hearth furnaces (1, 30) are connected to another roller hearth furnace (1), which is connected to the downstream process route (28) and has an entry side (11), a parallel discharge side (14) and a buffer zone (18) of lifting elements (17) arranged between them.

9. A roller hearth furnace in accordance with claim 1, wherein the buffer zone is provided with a holding zone.

* * * * *

UNITED STATES PATENT AND TRADEMARK OFFICE

CERTIFICATE OF CORRECTION

PATENT NO. : 8,376,734 B2
APPLICATION NO. : 12/223740
DATED : February 19, 2013
INVENTOR(S) : Klein et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1175 days.

Signed and Sealed this
First Day of September, 2015

Michelle K. Lee

Michelle K. Lee
*Director of the United States Patent and Trademark Office*